US006169527B1

(12) United States Patent
Kanazawa et al.

(10) Patent No.: US 6,169,527 B1
(45) **Date of Patent: *Jan. 2, 2001**

(54) INTERLACE PLASMA DISPLAY APPARATUS PARTLY SHADING DISPLAY LINES

(75) Inventors: Yoshikazu Kanazawa; Toshio Ueda, both of Kawasaki (JP)

(73) Assignee: Fujitsu Limited, Kawasaki (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/908,445

(22) Filed: Aug. 7, 1997

(30) Foreign Application Priority Data

Feb. 25, 1997 (JP) ..... 9-040585

(51) Int. Cl.[7] ..... G09G 3/28

(52) U.S. Cl. ..... 345/60; 345/62; 345/63; 345/67; 315/169.4

(58) Field of Search ..... 345/60, 62, 63, 345/67, 68; 313/483–494; 315/169.4

(56) References Cited

U.S. PATENT DOCUMENTS 5,099,173 3/1992 Kim et al. ..... 313/385
5,103,328 * 4/1992 Numao ..... 359/53
5,400,046 * 3/1995 Ilcisin et al. ..... 345/58
5,436,634 * 7/1995 Kanazawa ..... 345/67
5,615,026 * 3/1997 Koden ..... 349/174
5,789,761 * 8/1998 Ihara et al. ..... 257/59

FOREIGN PATENT DOCUMENTS 2 657 713 8/1991 (FR) .
4-34819 2/1992 (JP) .
9-160525 6/1997 (JP) .
91-8438 10/1991 (KR) .

OTHER PUBLICATIONS

*Patent Abstracts of Japan*, vol. 6, No. 55 (E–101), Apr. 10, 1982 & JP A 56–167237 (Fujitsu Ltd), Dec. 22, 1981.

*Patent Abstracts of Japan*, vol. 97, No. 6, Jun. 30, 1997 & JP A 09–049909 (Fujitsu General Ltd), Feb. 18, 1997.

* cited by examiner

*Primary Examiner*—Dennis-Doon Chow
*Assistant Examiner*—Amr Awad
(74) *Attorney, Agent, or Firm*—Staas & Halsey LLP

(57) ABSTRACT

A plasma display panel displaying interlaced images is provided with shades blocking a part of the light emitted by respective outermost display lines, suppressing flicker caused by the part of the light emitted thereby and improving display quality.

22 Claims, 12 Drawing Sheets

INTERLACE PLASMA DISPLAY APPARATUS PARTLY SHADING DISPLAY LINES

BACKGROUND OF THE INVENTION

1. Field of the Invention

The present invention relates to a technique for driving a display panel consisting of display cells each having a memory function, and particularly, to a plasma display apparatus and a plasma display panel (PDP) capable of displaying interlaced images with reduced unnaturalness appearing on the first and the last display lines.

Images displayed on a display apparatus are classified into noninterlaced images and interlaced images. The noninterlaced images are displayed frame by frame with the use of every display lines in every frame. The interlaced images are displayed frame by frame by alternately using odd and even display lines, i.e., odd display lines in a given frame and even display lines in the next frame. The noninterlaced images are used to display, for example, fine characters an a computer display apparatus. The interlaced images are used to display, for example, animation on a television set. The present invention relates to a plasma display apparatus that displays interlaced images.

2. Description of the Related Art

Japanese Unexamined Patent Publication No. 9-160525 of the assignee of the present application discloses a plasma display apparatus for displaying interlaced images. The apparatus employs sustaining discharge electrodes that have slits along them. These slits serve as display lines. The apparatus alternately drives odd and even ones of the display lines field by field. As a result, a range of the display lines driven in odd fields vertically deviates by one display line from a range of the display lines driven in even fields. Then, a viewer sees oscillating images on the apparatus and this may give an unnatural feeling. In this way, the oscillating images deteriorate the display quality of the apparatus.

SUMMARY OF THE INVENTION

An object of the present invention is to provide a plasma display apparatus and a plasma display panel capable of displaying interlaced images without flicker on first and last display lines, thereby improving the display quality thereof.

In order to accomplish the object, the present invention provides a plasma display apparatus having shades for shading part of light emitted from first and last display lines, to reduce flicker. The apparatus has a plasma display panel consisting of first and second substrates, electrodes arranged in parallel with one another on at least one of the first and second substrates, discharge gas filled in a space between the first and second substrates, and a drive circuit for applying a voltage to the electrodes. Slits, each formed between an adjacent pair of the electrodes, serve as display lines. When a voltage is applied to the electrodes, the electrodes discharge and the display lines emit light. Odd and even ones of the display lines are alternately activated to display interlaced images. The shades block part of light emitted from each end display line.

The plasma display apparatus of the present invention shades and decreases the intensity of light from each end display line that causes flicker, thereby improving display quality.

The shades may block about half of light emitted from each end display line that causes flicker. When sustaining discharge electrodes provide display lines, the shades are structured to cover an outer one of a pair of sustaining discharge electrodes that form each end display line.

The shades may be arranged between the one of the first and second substrates that is on the display side and the space filled with the discharge gas. The shades may be arranged between the display-side substrate and a dielectric layer that covers the electrodes formed on the display-side substrate, so that the flicker reducing effect is independent of a view angle.

The shades may be black insulators.

The present invention is applicable not only to both standard plasma display panels and the one disclosed in the Japanese Unexamined Patent Publication No. 8-194320 for displaying interlaced images but also to any plasma display panel that displays interlaced images.

BRIEF DESCRIPTION OF THE DRAWINGS

The present invention will be more clearly understood from the description of the preferred embodiments as set forth below with reference to the accompanying drawings, wherein.

DESCRIPTION OF THE PREFERRED EMBODIMENTS

Before proceeding to a detailed description of the preferred embodiments of the present invention, a prior art plasma display apparatus will be described with reference to the accompanying drawings relating thereto for a clear understanding of the differences between the prior art and the present invention.

An AC PDP alternately applies a voltage waveform to two sustaining discharge electrodes, to maintain discharge between the electrodes and emit light. A discharge action lasts one to several microseconds after an application of a pulse. The discharge produces positive ions, which accumulate on the surface of an insulation layer above the electrodes to which a negative voltage is applied. Similarly, negative electrons accumulate on the surface of the insulation layer above the electrodes to which a positive voltage is applied.

A write pulse of high voltage (write voltage) is first applied to cause discharge that produces wall charge.

Thereafter, a sustaining pulse of lower voltage (sustaining voltage or sustaining discharge voltage) of opposite polarity is applied to increase the wall charge. The voltage of the wall charge exceeds a threshold discharge voltage, to start discharge. Namely, any cell in which a write discharge is once carried out, to produce a wall charge, causes a discharge whenever sustaining pulses of opposite polarities are alternately applied thereto. This is called the memory effect or memory function of the cell. The AC PDP uses this memory effect to display images.

A full-color AC PDP usually employs a 3-electrode structure and a surface discharge configuration. Some 3-electrode PDPs arrange three types of electrodes on the same substrate. Some 3-electrode PDPs arrange two types of electrodes on one substrate and electrodes of another type on an opposite substrate. When arranging three types of electrodes on the same substrate, one type of electrodes may be arranged on or below the remaining types of electrodes. Some PDPs are transmission PDPs that transmit visible light emitted from phosphor, so that a viewer may see the transmitted light. Some PDPs are reflection PDPs that reflect light from phosphor toward a viewer. Discharge cells are spatially isolated from adjacent cells by barriers or ribs. Some PDPs completely surround each cell with barriers, and some PDPs form barriers in only one direction and gaps in the other direction, to isolate each cell from the adjacent cells.

This specification takes as an example a reflection PDP that has first and second sustaining discharge electrodes on one substrate and third electrodes on an opposite substrate. The PDP forms barriers only along the third electrodes orthogonal to the first and second electrodes. Each of the first and second sustaining discharge electrodes is partly transparent.

Figure 1:
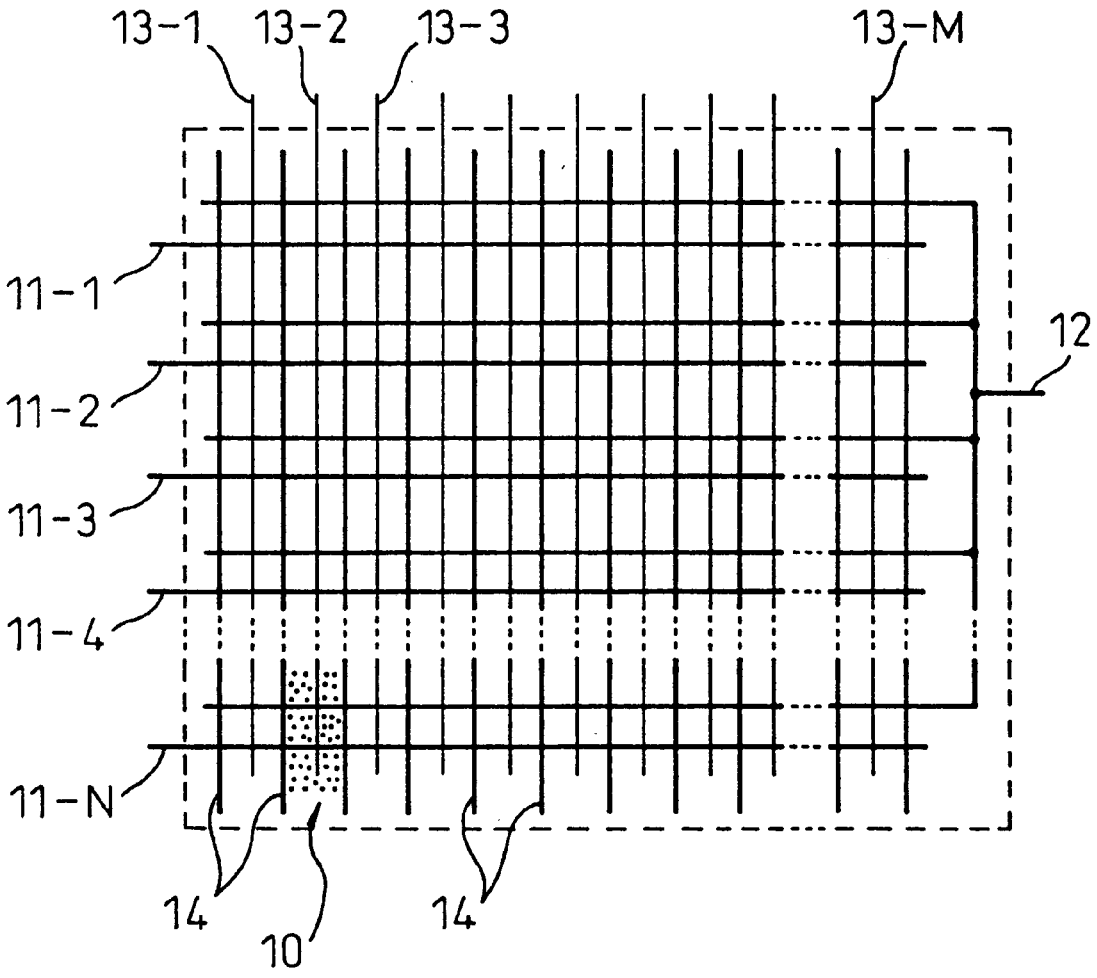
Fig.1 PRIOR ART
FIG. 1 is a plan view showing a 3-electrode, surface-discharge, alternating-current (AC) PDP according to a prior art.
Figure 2:
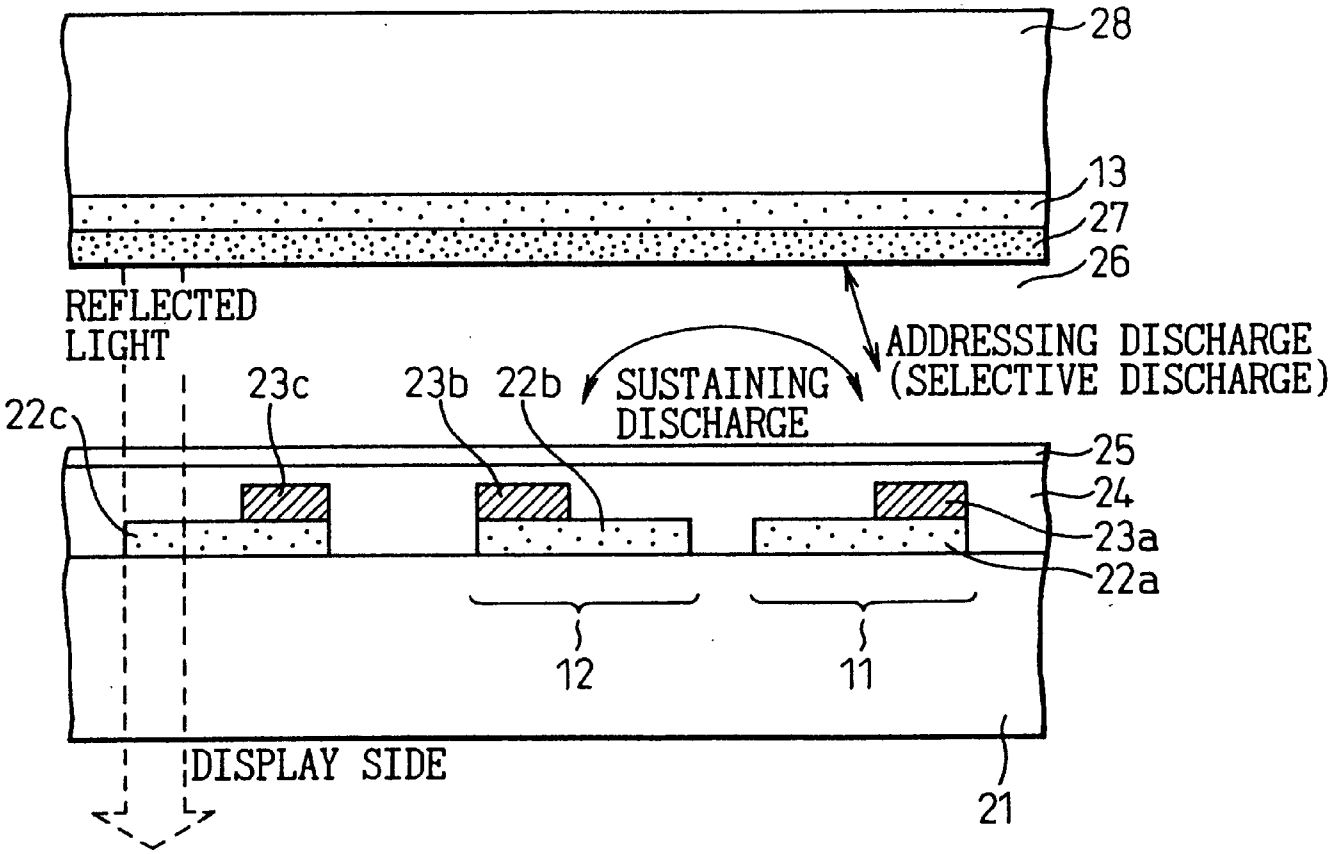
Fig. 2 PRIOR ART
FIGS. 2 and 3 are sectional views showing the PDP of the prior art.
Figure 3:
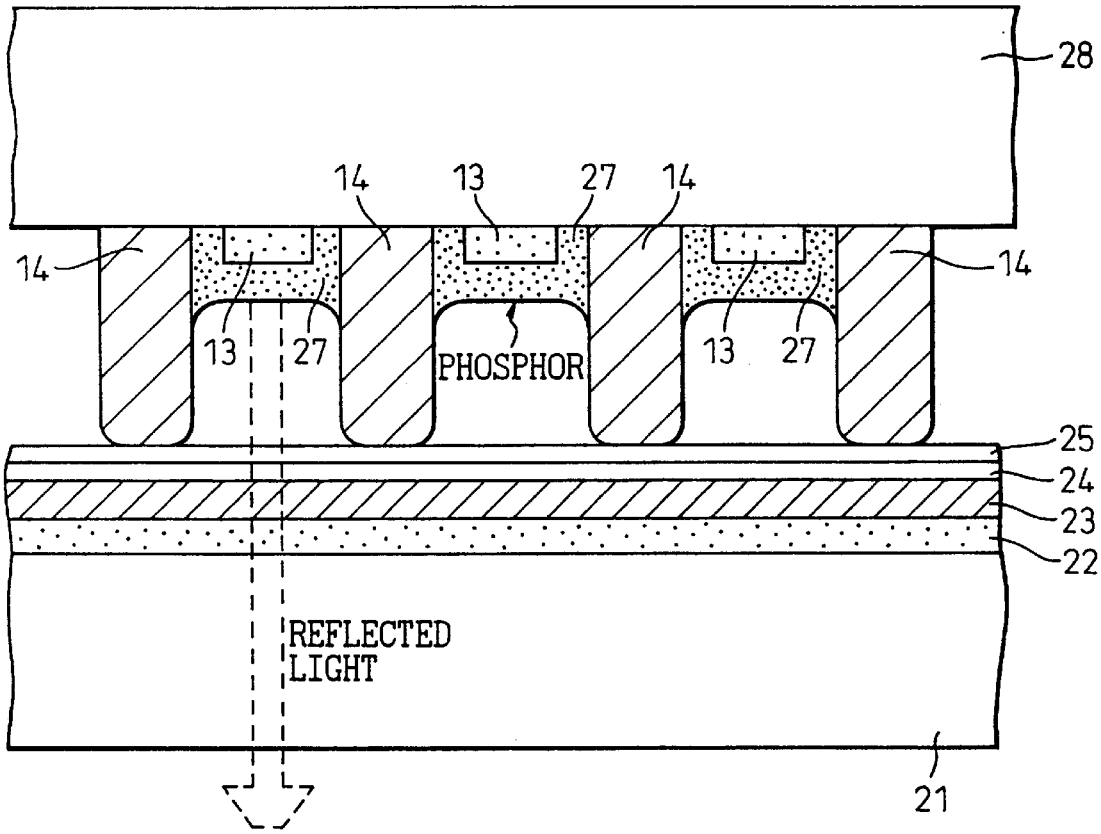
Fig. 3 PRIOR ART

FIG. 1 is a plan view showing a 3-electrode, surface-discharge PDP according to a prior art, FIG. 2 is a vertical section showing the PDP, and FIG. 3 is a horizontal section showing the PDP.

The PDP has two glass substrates 21 and 28. The substrate 21 has Y- and X-electrodes 11 and 12. The Y-electrodes 11 are first sustaining discharge electrodes, and X-electrodes 12 are second sustaining discharge electrodes. Each of the Y-electrodes 11 consists of a transparent electrode 22*a* and a bus electrode 23*a*. Each of the X-electrodes 12 consists of a transparent electrode 22*b* and a bus electrode 23*b*. The transparent electrodes transmit reflected light from phosphor. The bus electrodes are made of metal to prevent a voltage drop due to electrode resistance. The Y- and X-electrodes 11 and 12 are covered with a dielectric layer 24, which is covered with an MgO (magnesium oxide) protective film 25. The substrate 21 faces the substrate 28 on which third electrodes, i.e., address electrodes 13, are formed, disposed orthogonally to the sustaining discharge electrodes 11 and 12. A barrier 14 is formed between every adjacent pair of the address electrodes 13. Each address electrode 13 between the barriers 14 is covered with the phosphor 27 having a respective one of red, green, and blue light emitting properties. The glass substrates 21 and 28 are combined together so that the ridge of each barrier 14 is tightly in contact with the MgO film 25.

Figure 4:
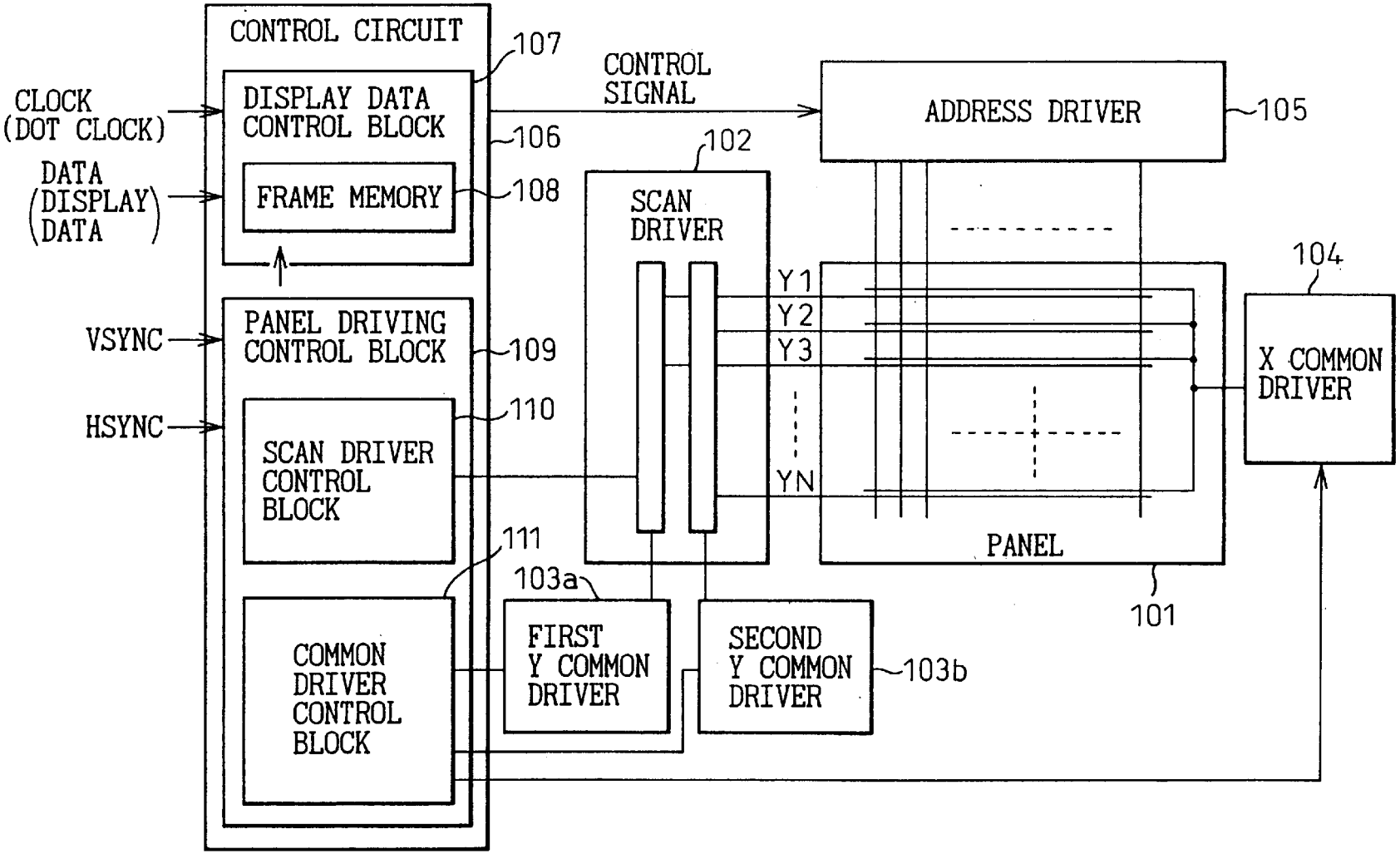
Fig. 4 PRIOR ART
FIG. 4 is a block diagram showing a plasma display apparatus for displaying interlaced images according to the prior art.

FIG. 4 is a block diagram showing peripheral circuits for displaying interlaced images on the PDP of FIGS. 1 to 3. The address electrodes 13 are individually connected to an address driver 105, which applies addressing pulses to them. The Y-electrodes 11 are individually connected to a scan driver 102, which is divided into an odd-Y-electrode driving block and an even-Y-electrode driving block. A Y common driver generates sustaining pulses and applies them to the Y-electrodes 11. The Y common driver is divided into first and second Y common drivers 103*a* and 103*b*. The scan driver 102 generates scan pulses during addressing discharge. The Y common drivers 103*a* and 103*b* generate sustaining pulses, which are applied to the Y-electrodes 11 through the scan driver 102. The X-electrodes 12 for all display lines are connected together. An X common driver 104 generates write pulses and sustaining pulses. A control circuit 106 controls these drivers and is controlled by external signals such as synchronous signals CLOCK, VSYNC, and HSYNC and display data signal DATA.

Figure 5:
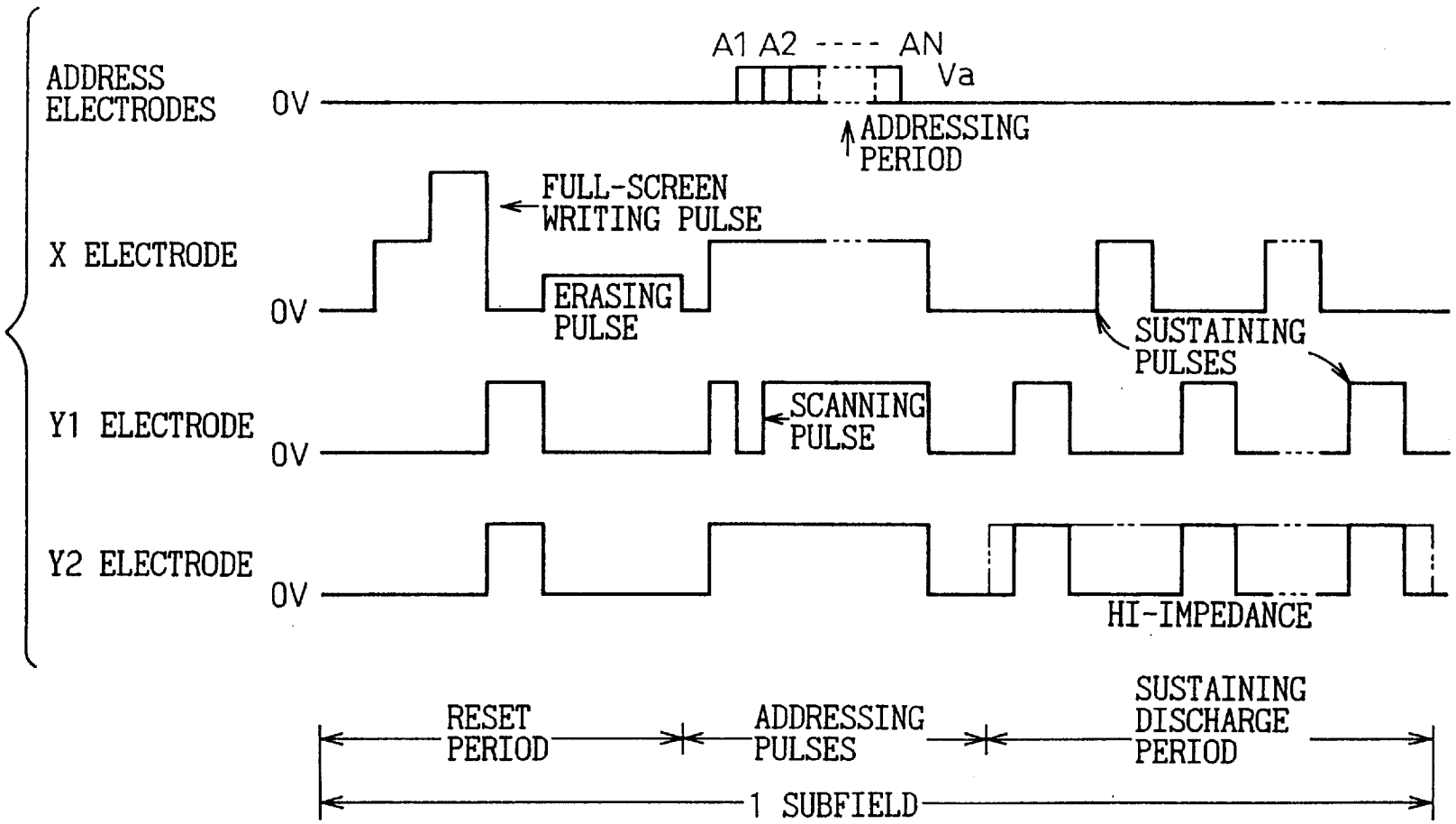
Fig.5 PRIOR ART
FIG. 5 shows waveforms for driving the PDP of the prior art.

FIG. 5 shows waveforms for driving the PDP of FIGS. 1 to 3 with the circuit of FIG. 4, to display interlaced images. The figure shows a subfield employed by an addressing/sustaining discharge separated write addressing technique. The subfield is composed of a reset period, an addressing period, and a sustaining discharge period. In the reset period, the Y-electrodes are each set to 0 V. At the same time, a full-screen writing pulse having a voltage Vs+Vw of about 300 V is applied to the X-electrodes. Thereafter, sustaining discharges are carried out, and an erasing pulse is applied to carry out an erasing discharge. The reset period equalizes the state of every cell without regard to the display state of a preceding subfield so that the next addressing (writing) discharge may stably be carried out.

In the addressing period, an addressing discharge is carried out sequentially on the display lines, to turn on and off the cells according to display data. First, a scanning pulse is applied to a given Y-electrode, and addressing pulses of a voltage Va of about 50 V are applied to the address electrodes corresponding to selected cells to be turned on. This causes a discharge between the address electrode and the Y-electrode of each selected cell. This discharge serves as a priming function, to cause a discharge between the X-electrode and the Y-electrode of each selected cell, thereby to accumulate a wall charge sufficient to cause a sustaining discharge on the MgO film on the X- and Y-electrodes of the cell along the corresponding display line.

The same operation is carried out on the other display lines sequentially until new display data is written for all display lines.

In the sustaining discharge period, a sustaining pulse of a voltage Vs of about 180 V is applied alternately to the Y- and X-electrodes, to let the subfield display an image. Since this is an interlaced image, the Y-electrodes corresponding to the display lines on which no discharge is carried out are kept in a high-impedance state, to reduce power consumption.

The addressing/sustaining discharge separated write addressing technique determines an intensity level according to the length of the sustaining discharge period, i.e., the number of sustaining pulses.

Figure 6:
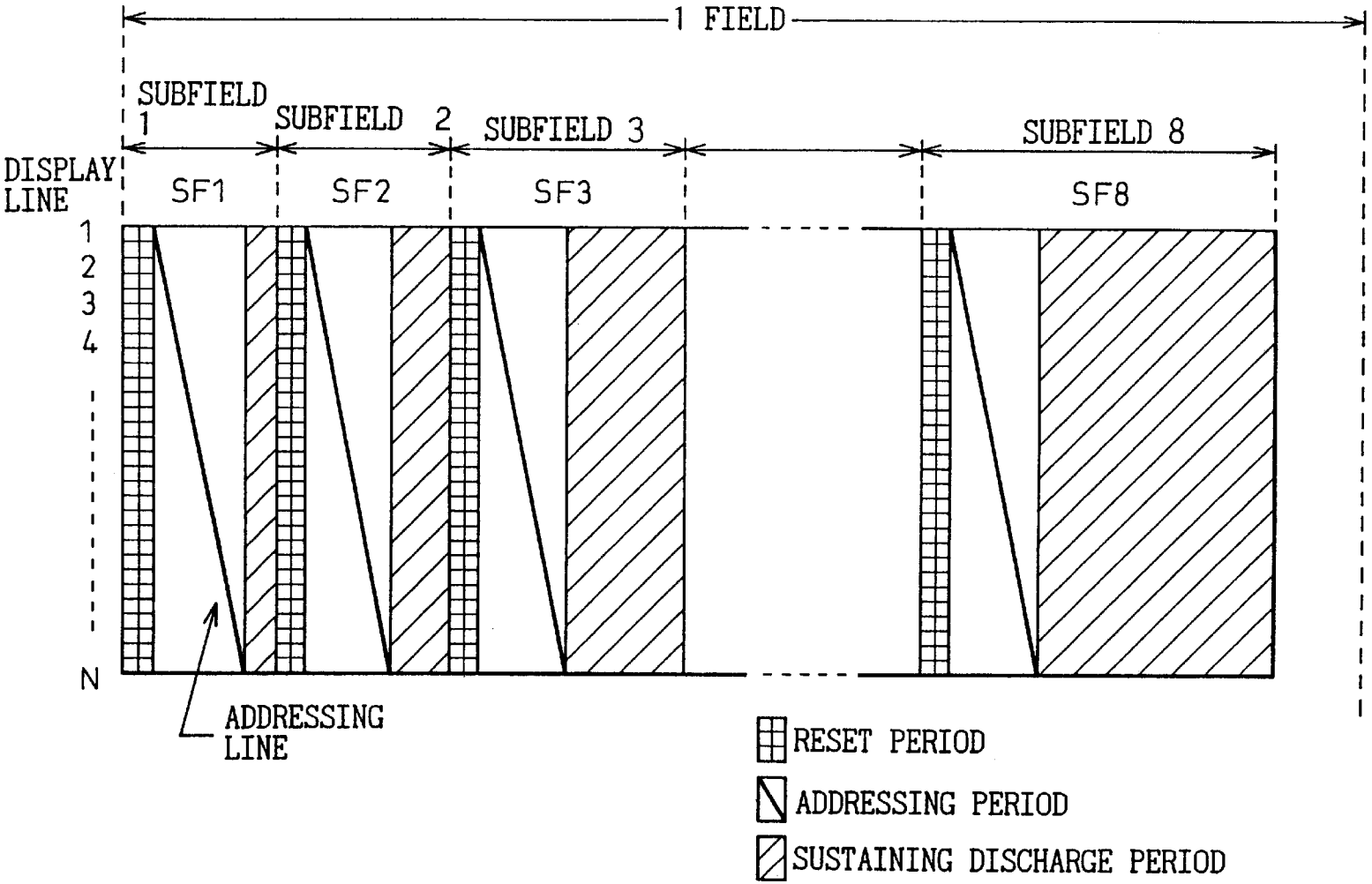
Fig. 6 PRIOR ART
FIG. 6 shows an arrangement of subfields for displaying intensity levels.

FIG. 6 shows an example of displaying any one of 256 intensity levels with the use of a field divided into eight subfields SF1 to SF8. A given field displays either odd display lines or even display lines, and the next field displays the other of the odd and even display lines.

The subfields SF1 to SF8 each have identical reset and addressing periods. The subfields have sustaining discharge periods having the ratio of 1:2:4:8:16:32:64:128. By selecting the subfields to be turned on, any one of 256 intensity levels, ranging from 0 to 255, is displayed.

Figure 7:
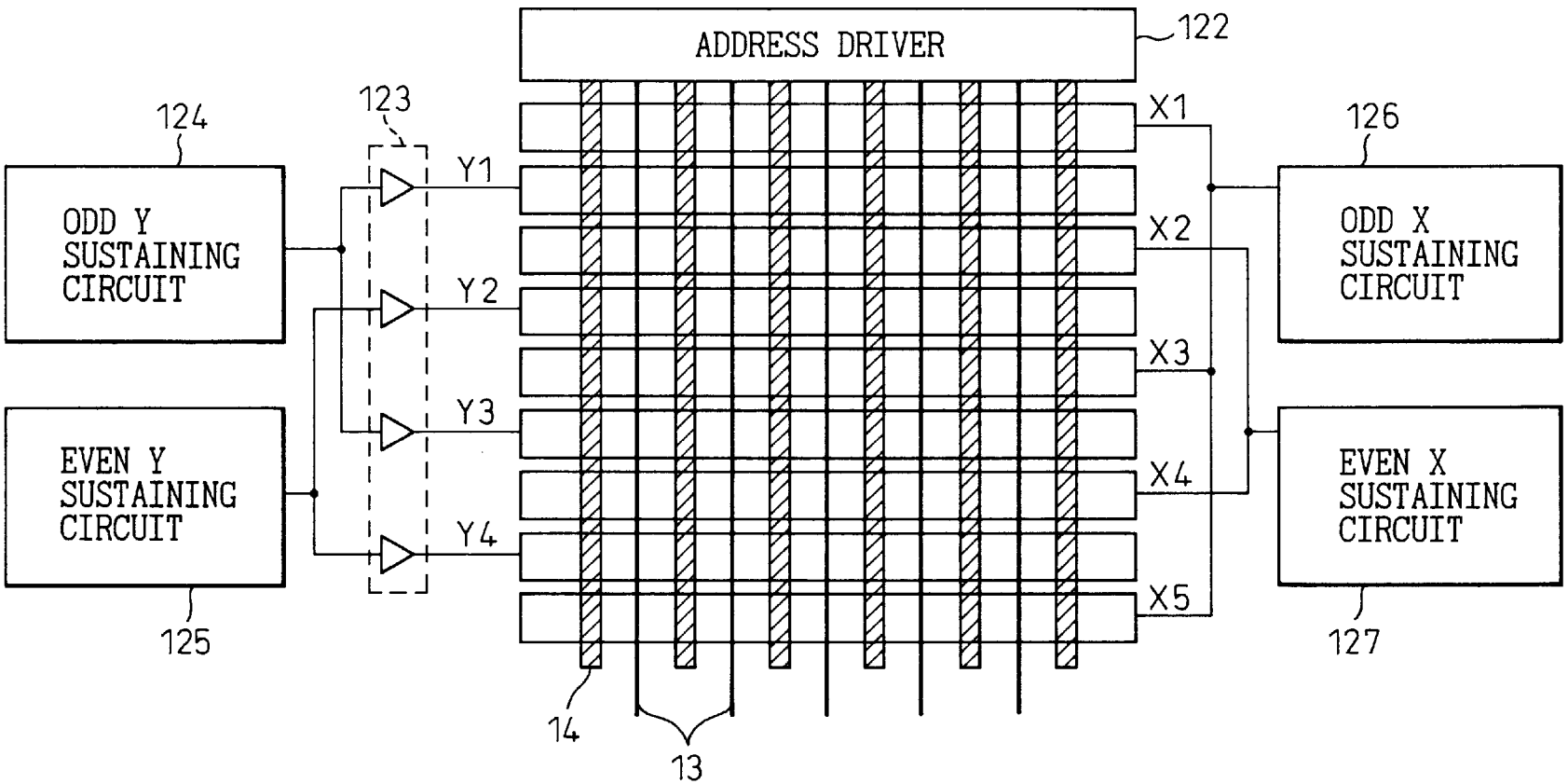
FIG. 7 shows an interlace display panel having no barriers along the Y- and X-electrodes and circuits for driving the panel according to the prior art.
Figure 8:
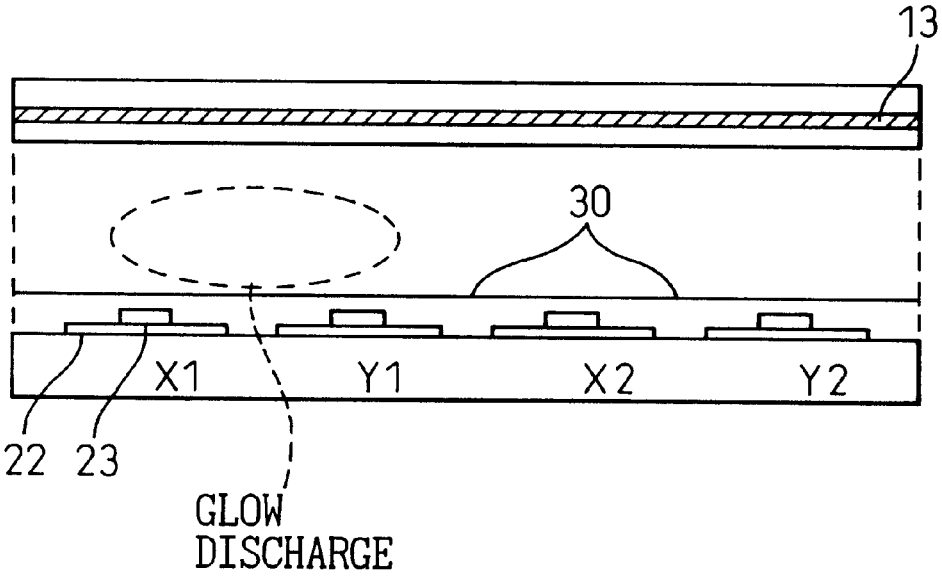
FIG. 8 is a sectional view showing the display panel of FIG. 7.
Figure 9:
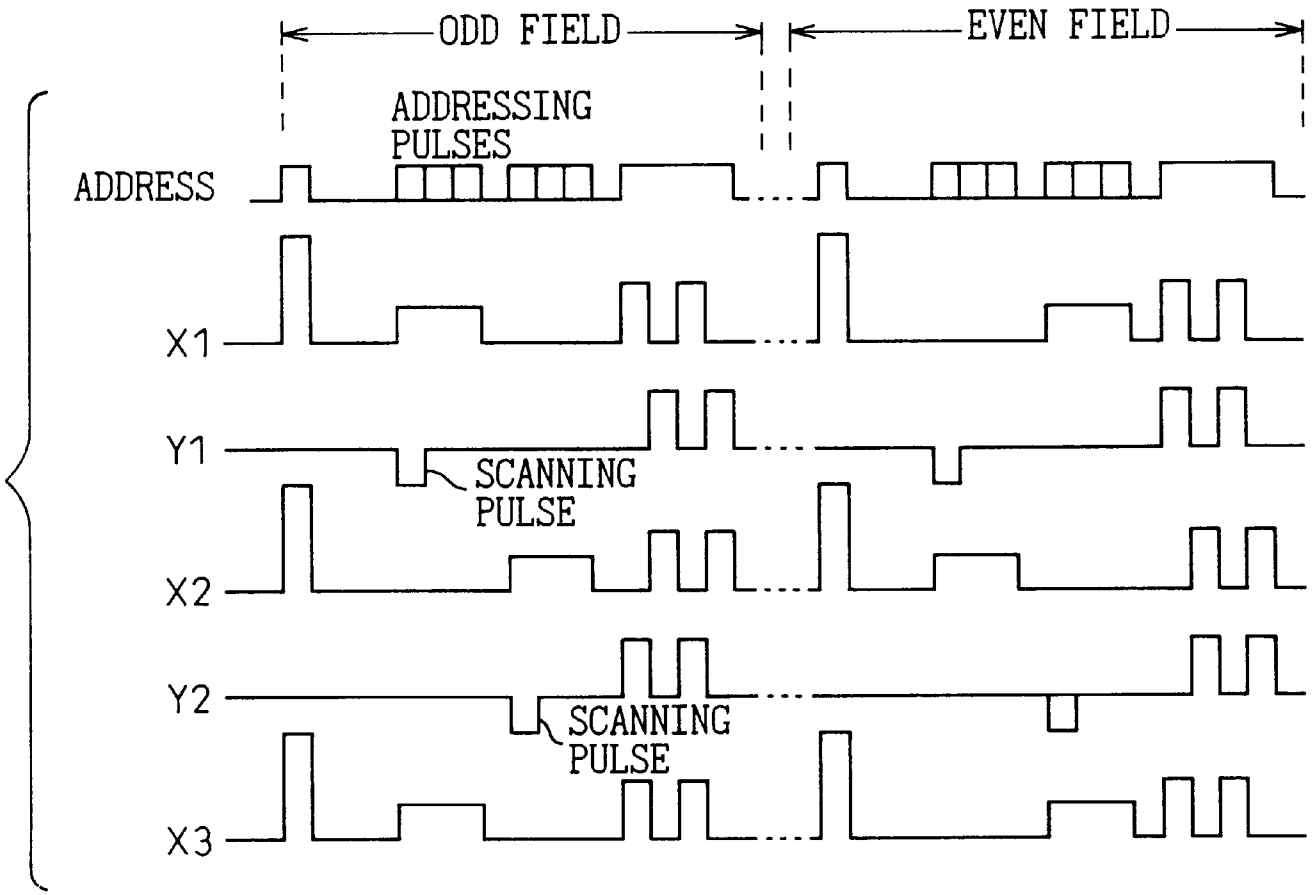
FIG. 9 shows waveforms for driving the display panel of FIG. 7.

FIG. 7 shows a PDP of the plasma display apparatus disclosed in the Japanese Unexamined Patent Publication No. 9-160525 of the assignee of the present application for displaying interlaced images. The PDP uses slits, formed along each side of each Y-electrode, as discharge slits. FIG. 8 is a sectional view showing the PDP, and FIG. 9 shows waveforms for driving the PDP. Every slit between sustaining discharge electrodes serves as a display line. Slits on which sustaining discharge is carried out are dependent on a field. For example, in odd fields, slits X1-Y1, X2-Y2, X3-Y3, and the like, i.e., odd display lines, carry out sustaining discharge. In even fields, slits Y1-X2, Y2-X3, Y3-X4, and the like, i.e., even display lines carry out sustaining discharge. In each odd field, the first display line is between the X- and Y-electrodes X1 and Y1. Discharge on this display line occurs along an intermediate line between the electrodes X1 and Y1 and spreads over these electrodes. In each even field, the first display line is between the Y- and X-electrodes Y1 and X2. Discharge on this display line occurs along an intermediate line between the electrodes Y1 and X2 and spreads over these electrodes. This means that discharge on the electrode Y1 occurs in both the odd and even fields. On the other hand, discharge on the electrode X1 occurs only in the odd fields. Namely, the electrode X1 is turned on and off at intervals of 30 Hz to cause flicker. The same flicker occurs on the last display line. Namely, discharge on the last display line spreads to the X-electrode Xn+1 that forms the last display line. Accordingly, the electrode Xn+1 is turned on and off at intervals of 30 Hz.

Figure 10:
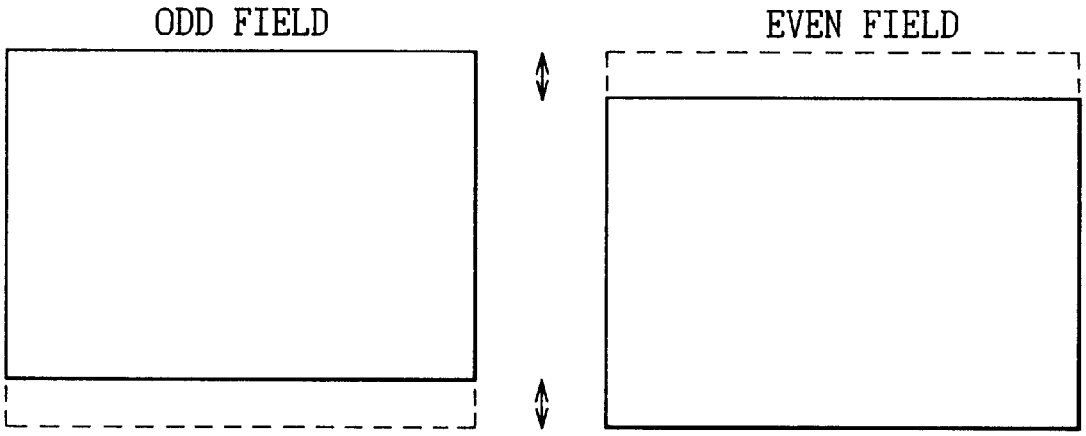
FIG. 10 shows the problem of the prior art.

In this way, the PDP of FIG. 7 displays interlaced images by alternately activating odd and even display lines, field by field. FIG. 10 shows this state. In FIG. 10, a display range of odd fields vertically deviates by one display line from a display range of even fields. The odd and even fields alternate at intervals of 30 times per second, to form each 30 images per second. The X-electrode X1 emits light 30 times per second, i.e., 30 Hz. The same happens on the X-electrode Xn+1. Human eyes usually sense flicker on light emission of 50 Hz or lower. Accordingly, the first (top) and last (bottom) display lines cause flicker with the range of light-emitting display lines vertically oscillating at intervals of 30 Hz as shown in FIG. 10. This provides a viewer with an unnatural feeling and drastically deteriorates display quality. On the other hand, intermediate display lines, between the top and bottom display lines, provide no flicker because light emission from the odd fields overlaps that of the even fields through the intermediate display lines.

This problem becomes conspicuous when the pitch of the display lines is large in the vertical direction, or when a viewer is close to the PDP.

Figure 11:
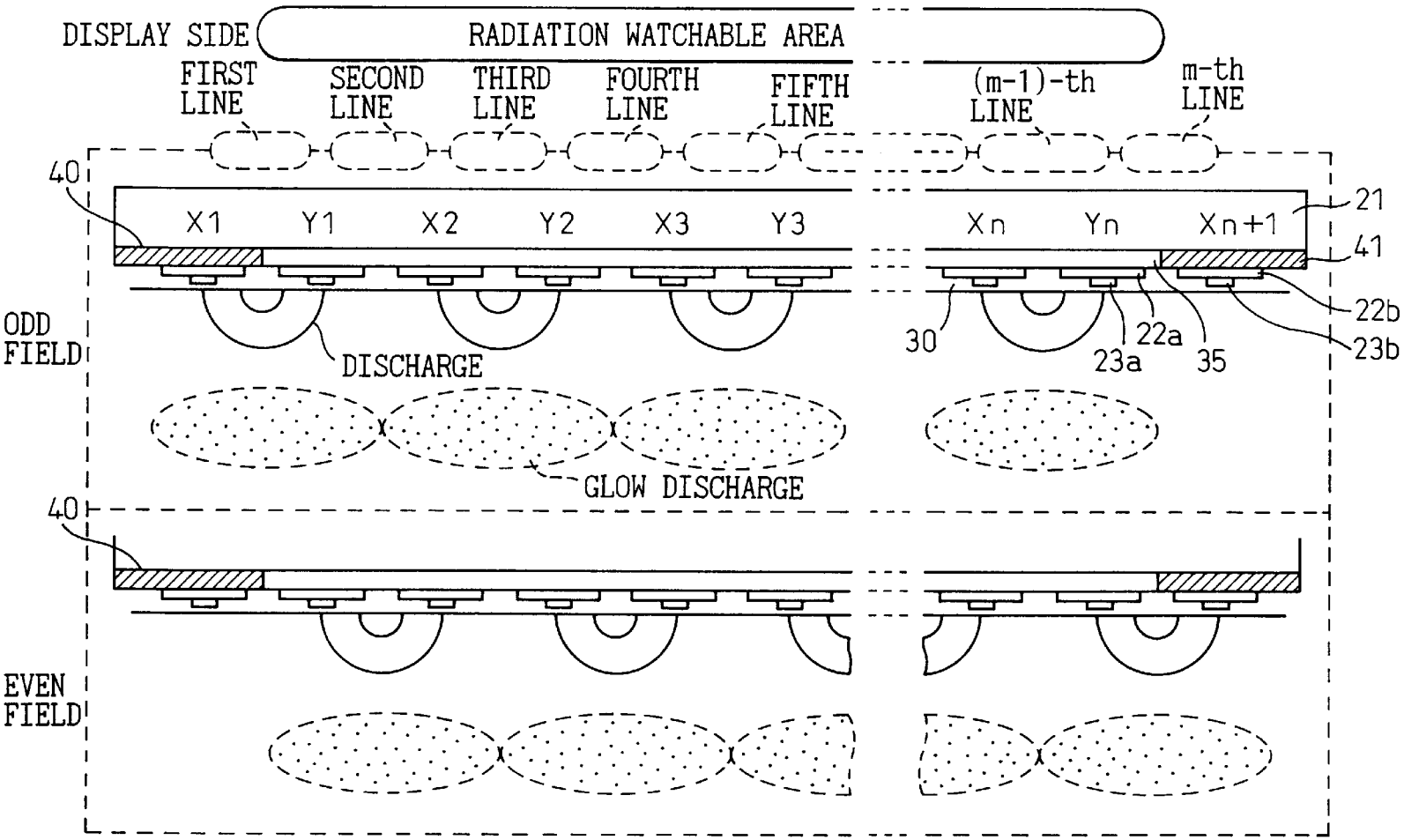
FIG. 11 shows a PDP according to a first embodiment of the present invention.

FIG. 11 shows a PDP according to the first embodiment of the present invention. This embodiment is applicable to the PDP of FIG. 7. The PDP is provided with the same circuits as those of FIG. 7 and is driven by the waveforms of FIG. 9. Accordingly, only the characteristic part of the embodiment will be explained.

The PDP of the first embodiment has a display-side glass substrate 21. The substrate 21 is covered with an insulation layer 35 made of, for example, glass. The insulation layer 35 includes black shades 40 and 41 only under X-electrodes X1 and Xn+1. Namely, the shades 40 and 41 cover the electrodes X1 and Xn+1. As explained above, the first display line in each odd field is between the X- and Y-electrodes X1 and Y1. Discharge on this display line occurs along an intermediate line between the electrodes X1 and Y1 and spreads to the electrodes X1 and Y1. The first display line in each even field is between the Y- and X-electrodes Y1 and X2. Discharge on this display line occurs along an intermediate line between the electrodes Y1 and X2 and spreads to the electrodes Y1 and X2. This means that discharge on the electrode Y1 occurs in both the odd and even fields. On the other hand, discharge on the electrode X1 occurs only in the odd fields. Namely, discharge on the electrode X1 occurs at intervals of 30 Hz to cause flicker. The same flicker occurs on the last display line.

If there are no shades 40 and 41, the flicker on the X-electrodes X1 and Xn+1 at intervals of 30 Hz is visible as it is. The shades 40 and 41 hide such flicker on the electrodes X1 and Xn+1.

In the first embodiment, the shades 40 and 41 are made by partly blackening the transparent insulation layer 35 formed on the glass substrate 21. However, the shades 40 and 41 may be made by processing the surface of the glass substrate 21. Alternatively, the shades 40 and 41 may be made of conductive material such as metal.

The locations of the shades 40 and 41 are optional if they can block flicker on the electrodes X1 and Xn+1. For example, the shades 40 and 41 may be formed on the display side of the glass substrate 21. In order to block flickering light from the electrodes X1 and Xn+1 in any direction, it is preferable to arrange the shades 40 and 41 as close to a discharge space as possible. This is the reason why the first embodiment forms the shades 40 and 41 in the dielectric layer 35 that is between the glass substrate 21 and the discharge space.

Figure 12:
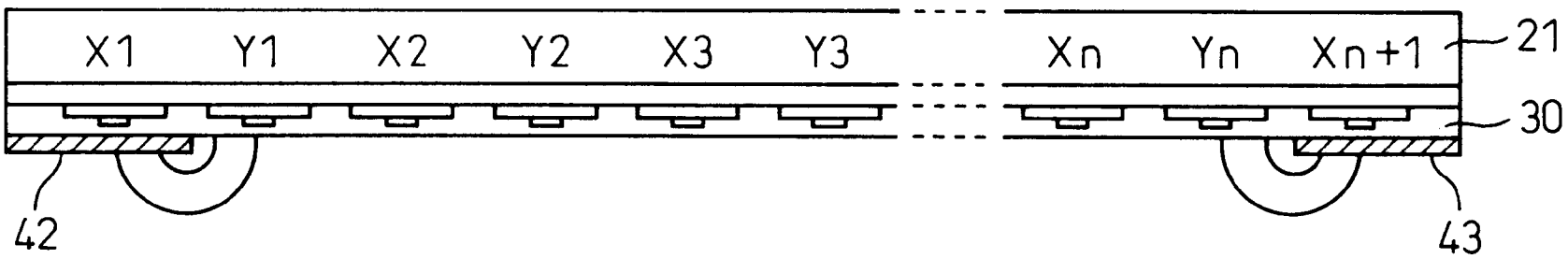
FIG. 12 shows a PDP according to a second embodiment of the present invention.

FIG. 12 shows a PDP according to the second embodiment of the present invention. This embodiment forms shades 42 and 43 on the surface of a dielectric layer 30 that is in contact with a discharge space. In this case, the shades 42 and 43 must be made of insulating material. If they are made of conductive material such as metal, they badly affect discharge in the discharge space.

As explained above, the present invention provides a PDP capable of displaying interlaced images without flicker on the first and last display lines and without oscillation of the screen, thereby improving display quality.

What is claimed is:

1. A plasma display apparatus having a plasma display panel for displaying interlaced images by alternately activating odd and even display lines, the plasma display panel comprising:

first and second substrates;

electrodes arranged adjacent one another on at least one of the substrates, adjacent pairs of electrodes defining respective said display lines therebetween, first and second outermost said pairs of electrodes defining respective first and second outermost display lines, each electrode comprising a transparent electrode and a bus electrode;

a discharge gas filled between the substrates;

a drive circuit applying voltages to the electrodes producing discharges between adjacent electrodes and resulting light emission along the respective display lines; and a pair of shading elements respectively disposed at the first and second outermost display lines, only, of the display lines and blocking corresponding parts of the light emitted by, only, the respective, first and second outermost display lines.

2. The apparatus of claim 1, wherein each shading element blocks, only, the outer half of the light emitted by the respective outermost display line.

3. The apparatus of claim 2, wherein:

the electrodes defining the display lines are sustaining discharge electrodes; and each shading element covers, only, an outermost one of the respective outermost pair of the sustaining discharge electrodes that form the respective, outermost display line.

4. The apparatus of claim 2, wherein the shading elements are formed between the substrate that is on the display side of the panel and a discharge space within the panel which is filled with the discharge gas.

5. The apparatus of claim 4, wherein the shading elements are formed between the display-side substrate and a dielectric layer that is formed on the display-side substrate and covers the electrodes.

6. The apparatus of claim 2, wherein:

the electrodes that form the display lines are sustaining discharge electrodes; and the shading elements are formed on a dielectric layer that covers the sustaining discharge electrodes.

7. The apparatus of claim 2, wherein the shading elements are black.

8. The apparatus of claim 2, wherein the shading elements are made of insulating material.

9. The apparatus of claim 1, wherein the shading elements are formed between the substrate that is on the display side of the panel and a discharge space within the panel which is filled with the discharge gas.

10. The apparatus of claim 9, wherein the shading elements are formed between the display-side substrate and a dielectric layer that is formed on the display-side substrate and covers the electrodes.

11. The apparatus of claim 1, wherein:

the electrodes that form the display lines are sustaining discharge electrodes; and the shading elements are formed on a dielectric layer that covers the sustaining discharge electrodes.

12. The apparatus of claim 1, wherein the shading elements are black.

13. The apparatus of claim 1, wherein the shading elements are made of insulating material.

14. A plasma display panel comprising:

first and second substrates;

electrodes arranged adjacent one another on at least one of the substrates, adjacent pairs of electrodes defining respective display lines therebetween, first and second outermost said pairs of electrodes defining respective first and second outermost display lines, each electrode comprising a transparent electrode and a bus electrode;

a discharge gas between the substrates;

a drive circuit applying voltages to the electrodes producing discharges between adjacent parallel electrodes and resulting light emission along the respective display lines;

a pair of shading elements respectively disposed at the first and second outermost display lines, only, of the display lines and blocking corresponding parts of the light emitted by, only, the respective, first and second outermost display lines.

15. The apparatus of claim 14, wherein the plasma display panel displays interlaced images by alternately activating odd and even said display lines.

16. The substrate of claim 15, wherein the shading elements are formed between the display-side substrate and a dielectric layer that is formed on the display-side substrate and covers the electrodes.

17. A substrate of a plasma display panel having electrodes adjacent one another and defining respective display lines therebetween, each display line having a corresponding display line axis disposed substantially centrally between the respective adjacent electrodes which define the display line, first and second outermost sets of adjacent electrodes defining respective, first and second outermost display lines, comprising:

first and second shading elements opaque to display light emitted by the display panel and respectively disposed in alignment with the first and second outermost sets of adjacent electrodes, only, each shading element extending transversely to, and substantially from, the corresponding center axis of the respective display line toward a corresponding outer perimeter boundary of the substrate.

18. The substrate of claim 17, wherein the shading elements are formed between the substrate, disposed on the display side of the display panel, and a discharge space within the panel which is filled with a discharge gas.

19. The substrate of claim 17, wherein the shading elements are black.

20. The substrate of claim 17, wherein the shading elements are made of an insulating, opaque material.

21. A substrate of a plasma display panel having electrodes extending in the first direction and spaced in a second direction, perpendicular to the first direction, successive pairs of adjacent electrodes defining respective and alternating, odd and even numbered display lines therebetween and displaying interlaced images by alternately activating the odd and even display lines in respective and alternating, odd and even numbered fields, comprising:

first and second elements extending in the first direction and associated, respectively and only, with first and second outermost display lines, the first and second elements having corresponding inner edges aligned substantially with central axes of the outermost first and second display lines, respectively, and of a width in the second direction, perpendicular to the first direction, sufficient to block transmission of light produced by non-overlapping discharge portions of, only, the first and second outermost display lines, respectively of the odd and even numbered fields.

22. A substrate of a plasma display panel displaying interlaced images by alternately activating odd and even display lines extending in parallel in a first direction and spaced in a second direction, perpendicular to the first direction, between first and second outermost display lines, parts of the corresponding displays of the first and second outermost display lines, only, having a flickering display characteristic visible to human sight, the substrate comprising:

first and second elements disposed relative to the first and second outermost display lines, only, and blocking from sight, only, the parts of the corresponding displays of the first and second outermost display lines having the flickering display characteristic.

* * * * *